US012098878B2

(12) United States Patent
Liberati et al.

(10) Patent No.: US 12,098,878 B2
(45) Date of Patent: Sep. 24, 2024

(54) APPLIANCE FAN ASSEMBLY

(71) Applicant: WHIRLPOOL CORPORATION, Benton Harbor, MI (US)

(72) Inventors: Daniele Liberati, Pero (IT); Matteo Parnisari, Cassinetta (IT); Andrea Olivani, Milan (IT)

(73) Assignee: WHIRLPOOL CORPORATION, Benton Harbor, MI (US)

( * ) Notice: Subject to any disclaimer, the term of this patent is extended or adjusted under 35 U.S.C. 154(b) by 0 days.

(21) Appl. No.: 17/528,446

(22) Filed: Nov. 17, 2021

(65) Prior Publication Data

US 2023/0152022 A1 May 18, 2023

(51) Int. Cl.

| | |
|---|---|
| ***F04D 29/66*** | (2006.01) |
| ***F04D 29/42*** | (2006.01) |
| ***F25D 17/04*** | (2006.01) |
| ***F25D 17/06*** | (2006.01) |

(52) U.S. Cl.

CPC ..... *F25D 17/062* (2013.01); *F04D 29/4226* (2013.01); *F04D 29/668* (2013.01); *F25D 17/045* (2013.01)

(58) Field of Classification Search

CPC ... F25D 17/062; F04D 29/4226; F04D 29/668
See application file for complete search history.

(56) References Cited

U.S. PATENT DOCUMENTS

| | | | | |
|---|---|---|---|---|
| 10,753,667 | B2 * | 8/2020 | Zhu | F25D 17/04 |
| 10,969,157 | B2 | 4/2021 | Cheng et al. | |
| 2017/0336127 | A1 * | 11/2017 | Fei | F25D 17/045 |
| 2020/0386468 | A1 | 12/2020 | Matsuno et al. | |
| 2021/0231358 | A1 * | 7/2021 | Gupta | F25D 17/08 |

FOREIGN PATENT DOCUMENTS

| | | | |
|---|---|---|---|
| CN | 106168428 | A | 11/2016 |
| CN | 106225383 | B | 5/2018 |
| EP | 3343141 | A1 | 7/2018 |
| EP | 3343142 | A1 | 7/2018 |

* cited by examiner

*Primary Examiner* — Sabbir Hasan
(74) *Attorney, Agent, or Firm* — Brooks Kushman, P.C.

(57) ABSTRACT

A fan assembly for use in an appliance provided with a housing including a first sidewall forming a first outlet and a second outlet, a fan disposed in the housing and configured to expel cooled air through the first outlet and the second outlet to a number of compartments of the appliance, a damper including an annular rim and a second sidewall extending from at least a portion of the annular rim, the damper configured to rotate to completely or partially cover the first outlet, the second outlet, or the first outlet and the second outlet, and a wiper including a main body disposed between the first sidewall and the second sidewall and configured to block the cooled air from traveling between the first sidewall and the second sidewall.

17 Claims, 5 Drawing Sheets

APPLIANCE FAN ASSEMBLY

TECHNICAL FIELD

The present disclosure relates to a fan assembly for use in household appliances such as refrigerators.

BACKGROUND

Refrigerators generally may include a fan assembly that controls or regulates the amount of cooled air provided to one or more compartments of the refrigerator. The fan assembly may be disposed in a cold air passage to maintain a desired temperature of each compartment. The fan assembly may include a frame provided with one or more openings or air passages that may route cooled air to the compartments and a damper that may be rotated by a motor to selectively open or close the air passages. The damper may be coaxially arranged between the fan and the frame and may move within a gap between the fan and the frame.

SUMMARY

According to one embodiment, a fan assembly for use in an appliance is provided. The fan assembly may include a housing, a fan, a damper, and a wiper. The housing may be provided with a first sidewall forming a first outlet and a second outlet and the fan may be disposed in the housing and configured to expel cooled air through the first outlet and the second outlet to a number of compartments of the appliance. The damper may include an annular rim and a second sidewall extending from at least a portion of the annular rim. The damper may be configured to rotate to completely or partially cover the first outlet and the second outlet. The wiper may be provided with a main body disposed between the first sidewall and the second sidewall to block the cooled air from traveling between the first sidewall and the second sidewall.

According to another embodiment, another fan assembly is provided. The fan assembly may include a housing, a fan, a damper, and a first wiper. The housing may include a first sidewall that may at least partially form a first outlet, that may be disposed on a first side of the housing, and a second outlet that may be disposed on a second side of the housing. The second outlet may oppose the first outlet. The fan may be disposed in the housing and configured to rotate about a rotational axis to expel cooled air through the first outlet and the second outlet to a number of compartments of the appliance. The damper may include an annular rim and a second sidewall that may extend from at least a portion of the annular rim. The damper may be configured to rotate between a first position, in which the first outlet is covered, and a second position in which the second outlet is covered. The first wiper may include a main body that may be positioned with respect to the second sidewall so that when the damper is in the first position or the second position, the main body is disposed between the first sidewall and the second sidewall to block the cooled air from traveling between the first sidewall and the second sidewall.

According to yet another embodiment, a method of assembling a fan for use in a household appliance, is provided. The method may include: (a) providing a base that may include a first sidewall and second sidewall, that may form a first outlet and a second outlet disposed on opposing sides of a fan, the first sidewall may be radially spaced apart from the second sidewall; (b) inserting a rotatable damper between the first sidewall and the second sidewall, the rotatable damper including a third sidewall and configured to selectively rotate to open, partially block or completely block one or more of the first outlet and the second outlet; and (c) inserting a wiper between the first sidewall and the second sidewall so that as the rotatable damper rotates, the third sidewall is disposed between the wiper and the first sidewall.

DETAILED DESCRIPTION

Figure 1:
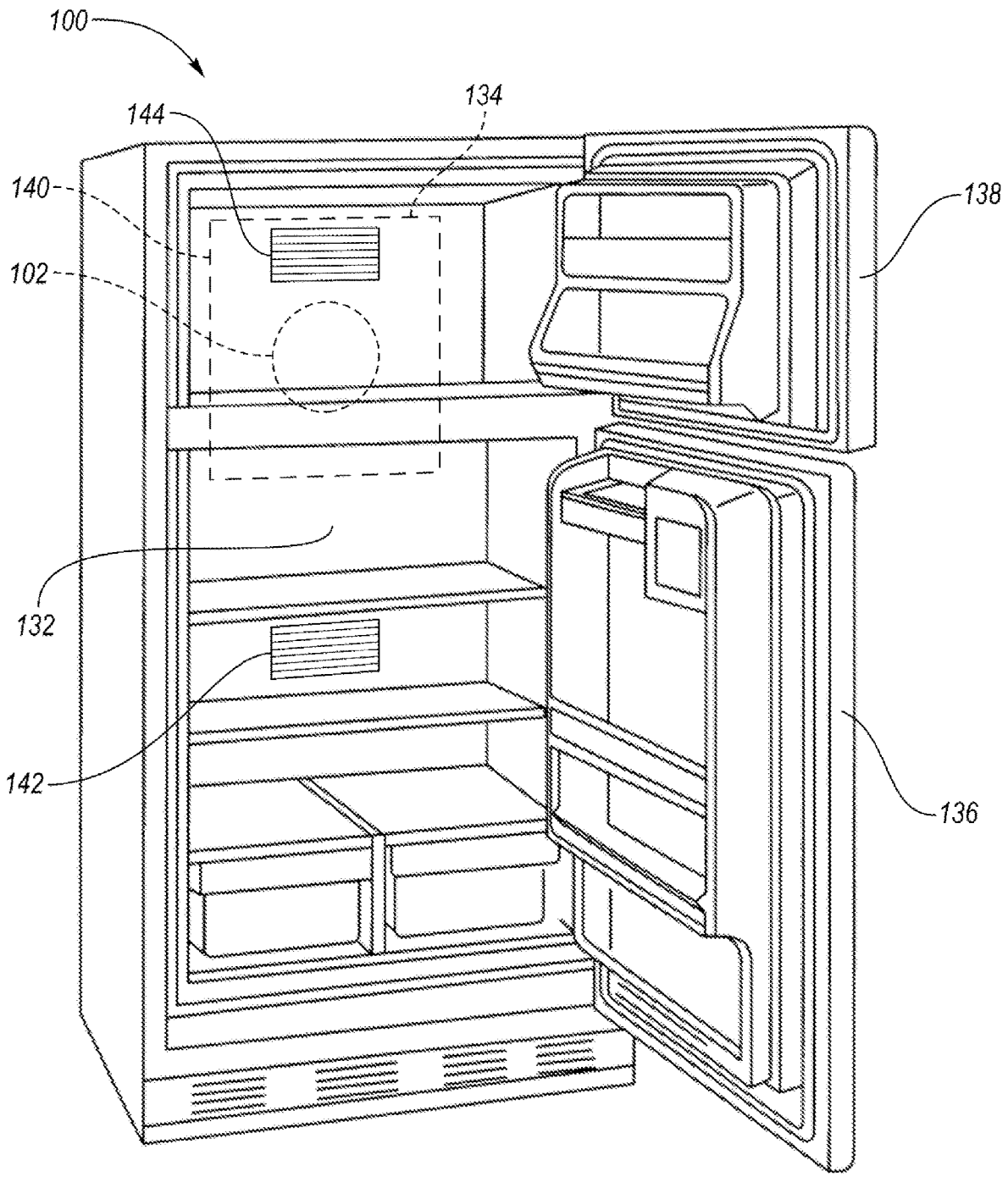
FIG. 1 illustrates a plan view of an exemplary top-mount type refrigerator according to one or more embodiments.

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

This invention is not limited to the specific embodiments and methods described below, as specific components and/or conditions may, of course, vary. Furthermore, the terminology used herein is used only for the purpose of describing particular embodiments of the present invention and is not intended to be limiting in any way.

As used in the specification and the appended claims, the singular form "a," "an," and "the" comprise plural referents unless the context clearly indicates otherwise. For example, reference to a component in the singular is intended to comprise a plurality of components.

The term "substantially" or "about" may be used herein to describe disclosed or claimed embodiments. The term "substantially" or "about" may modify a value or relative characteristic disclosed or claimed in the present disclosure. In such instances, "substantially" or "about" may signify that the value or relative characteristic it modifies is within ±0%, 0.1%, 0.5%, 1%, 2%, 3%, 4%, 5% or 10% of the value or relative characteristic.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). The term "and/or" includes any and all combinations of one or more of the associated listed items.

Although the terms first, second, third, etc. may be used to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

One problem with known refrigerators and fan assemblies is air that is supposed to be routed to the openings may instead move between the damper and the frame. This air leakage may decrease the efficiency of the fan and the refrigerator as a whole. Inefficient operation may require the refrigerator to draw additional power or cause inadvertent warming or cooling of the refrigerator compartments. The present disclosure attempts to provide one or more solutions to this problem.

Referring generally to the figures, a refrigerator 100 including a fan assembly 102 is provided. The fan assembly 102 may include a housing 104 that may include a first sidewall 106 that may form a first outlet 108 and a second outlet 110. A fan 112 may be disposed in the housing 104 so that as the fan 112 rotates, air such as cooled air, may be expelled through the first outlet 108, the second outlet 110, or both. A damper 114 may be arranged in the housing 104 so that the damper 114 circumferentially surrounds the fan 112. The damper 114 may include an annular rim 116 and a second sidewall 118 and the damper 114 may be configured to rotate to completely or partially cover the first outlet 108, the second outlet 110, or the first outlet 108 and the second outlet 110 to control the amount of cooled air is provided to the compartments of the refrigerator.

A number of wipers 120 may be disposed in the housing to block air flow from circumferentially moving between the first sidewall 106 and the second sidewall 118. The wiper 120 may include a main body 122 that may extend circumferentially along at least a portion of the first sidewall 106, the second sidewall 118, or both. The wiper 120 may include an attachment portion 124 that may extend from the main body 122. The attachment portion 124 may be fixed to the first sidewall 106. As an example, the attachment portion 124 may be formed by an arm that may be disposed in an aperture, such as a slot 126 formed by the first sidewall 106. The slot 126 and the attachment portion 124 may be configured to form a force-fit condition when the attachment portion 124 is inserted into the slot 126. The wiper 120 may include a retention flange 128 that may extend from the attachment portion 124 that may lie along an outer peripheral surface 130 of the first sidewall 106. The retention flange 128 may be configured to limit radial movement of the wiper 120 with respect to the first sidewall 106.

FIG. 1 generally shows the refrigerator 100. The refrigerator may be of the top-mount type, but it is understood that this disclosure could apply to any type of refrigerator, such as a side-by-side, two-door bottom mount, or French-Door Bottom Mount type. As shown in FIG. 1, the refrigerator 100 may have a first internal storage chamber or the fresh food compartment 132 configured to refrigerate and not freeze consumables within the fresh food compartment 132 by maintaining at a temperature above the freezing temperature of water, typically in the range of 35-40 degrees Fahrenheit. A second internal storage chamber or a freezer compartment 134 is disposed above the fresh food compartment 132. The freezer compartment 134 may be maintained below the freezing temperature of water and configured to freeze consumables within the freezer compartment 134 during normal use.

The refrigerator 100 includes cabinet walls that define the fresh food compartment 132 and the freezer compartment 134. The refrigerator 100 may have one or more doors 136, 138 that provide selective access to the interior volume of the refrigerator 100 where consumables may be stored. As shown, the fresh food compartment doors are designated 136, and the freezer door is designated 138. It may also be shown that the fresh food compartment 132 may only have two doors 136. Other configurations of two compartment refrigeration appliances are known including those where the freezer compartment is located below the fresh food compartment and where the freezer compartment is located in a side-by-side arrangement with the fresh food compartment. The present invention can be used in all of these different configurations.

The refrigerator 100 may include a machine compartment 140 that may be disposed behind the fresh food compartment 132 and the freezer compartment 134. The machine compartment 140 may house a number of components such as a compressor, an evaporator, and the fan assembly 102. The fresh food compartment 132 may include a refrigerator compartment outlet 142 and a freezer compartment outlet 144 that may each be fluidly connected, by a number of ducts (not illustrated), to the first outlet 108 and the second outlet 110, respectively. The fan assembly 102 may be configured to provide air cooled by one or more heat exchangers to the refrigerator compartment outlet 142 and the freezer compartment outlet 144.

Figure 2:
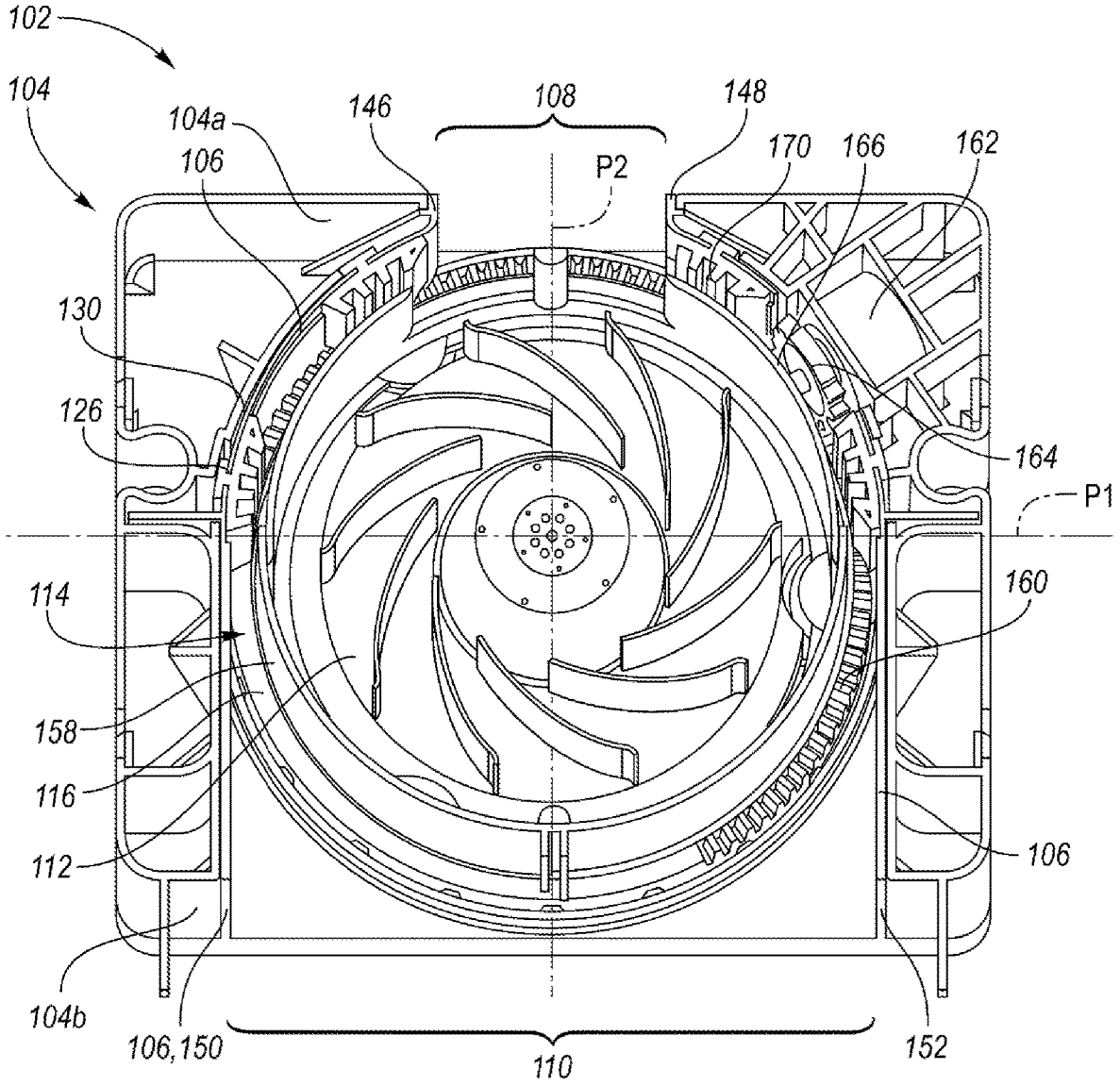
FIG. 2 illustrates a top-perspective view of an exemplary fan assembly including a damper disposed in a first position.

FIG. 2 depicts a top-perspective view of the fan assembly 102. The fan assembly 102 includes the housing 104 provided with the first sidewall 106 radially spaced apart from the fan 112. In one or more embodiments, the fan 112 may be an impeller configured to rotate about a rotational axis R to radially expel cooled air to the first outlet 108 and the second outlet 110. As an example, the fan 112 may include a frustoconical portion, that may be disposed in the center of the fan 112 about the rotational axis. The frustoconical portion may extend from a base of the fan 112 and a number of vanes or blades may extend along the base surface. As an example, one or more of the vanes may be positioned substantially tangential to an outer periphery of the frustoconical portion and extend to an outer periphery of the fan 112. The vane may have a curved surface to guide the air flow towards the outlets 108, 110 so that the flow remains laminar or at least not significantly turbulent. A radial distal portion of the vanes may be cupped so as to be curved away from the curve of the proximal portion of the blade.

The housing 104 may include a first side 104*a*, that may include the first outlet 108, and a second side 104*b* that may include the second outlet 110. The first side 104*a* and the second side 104*b* may be separated by a first plane P1 that may extend through the rotational axis R. As an example, the first outlet 108 may have a width that is less than a width of the second outlet 110. The first sidewall 106 may form a scroll chamber that may form the first and second outlets 108, 110. The scroll chamber may be surrounded by a housing shell that may lie along an outer periphery of the first sidewall 106. A top plate (not illustrated) may be disposed on top of the housing shell and the first sidewall to close out the housing shell and the scroll chamber.

The first sidewall 106 may not be continuous and may be formed by a number of segments. As an example, a first segment may include a first end 146 or first edge, that may form at least a portion of an inner periphery of the first outlet 108, and a second end 148 or second edge that may from at least a portion of an inner periphery of the second outlet 110. A second segment of the first sidewall may include a third end 150 or third edge and a fourth end 152 or fourth edge. The third end 150 may form a portion of the inner periphery of the first outlet 108 and the fourth end 152 may form a portion of the inner periphery of the second outlet 110.

A damper 114 may be provided in the scroll chamber to permit and prevent air flow from traveling into one or more of the first and second outlets 108, 110. The damper 114 may include an annular rim 156 and the second sidewall 158 that may extend in an axial direction from the annular rim 156. The damper 114 may be configured to rotate to selectively cover all or portions of either the first outlet 108 or the second outlet 110. As illustrated, the damper 114 is in a first position completely covering the second outlet 110. As an example, the annular rim 156 may include a number of gear teeth 160 that may be disposed radially outward from the second sidewall 158. The gear teeth may be disposed on at least half of the annular rim 156. A motor 162 and an input gear 164 may each be disposed in the housing 104. As an example, the motor 162 may be fixed to the housing shell and the input gear 164 may be disposed between portions of the first sidewall 106. The motor 162 may be configured to actuate to rotate the input gear 164 and the input gear 164 mat engage the gear teeth 160 to rotate the damper 114 between a number of positions to regulate air flow to the first and second outlets 108, 110.

An electrical connection (not illustrated) or power supply and a controller (not illustrated) may be operatively connected to the motor 162. The controller may receive data from a number of sensors including but not limited to a temperature sensor, a humidity sensor, or another sensor, as required. In response to a triggering condition, such as temperature of one or more of the compartments of the refrigerator falling below or exceeding a threshold, the damper 114 may be rotated by actuation of the motor 162.

The fan assembly 102 may include a third sidewall 166 that may be arranged coaxially and radially inward from the first sidewall 106. In one or more embodiments, the third sidewall 166 may be fixed with respect to the housing 104 but in other embodiments, the third sidewall 166 may be configured to rotate with respect to the housing 104. The third sidewall 166 may extend in an axial direction and have a height that is approximately equal to the height of the first sidewall 106. The third sidewall 166 may include a include a notch 168 that may partially form a portion of the first outlet 108. As an example, the third sidewall 166 may have a semi-circular shape and an open portion of the third sidewall 166 may face towards the second outlet 110.

The wiper 120 includes the main body 122 and a number of a fingers 170 that may extend substantially radially from the main body towards the third sidewall 166. The fingers 170 may be spaced apart from the third sidewall 166 to form a gap G. As the damper 114 rotates, the second sidewall 158 may move within the gap G. The fingers 170 may be spaced apart from one another to form insulation pockets. While the fan 112 is configured to route air through the first and second outlets 108, 110, some air may leak and move circumferentially between first sidewall 106 and the second and third sidewalls 118, 166. The insulation pockets may be disposed between the fingers 170 and may trap leaked air that circumferentially travels between the second and third sidewalls 118, 166. The main body 122 may lie along an inner surface of the first sidewall 106 to prevent air from traveling along the inner surface of the first sidewall 106.

Figure 3:
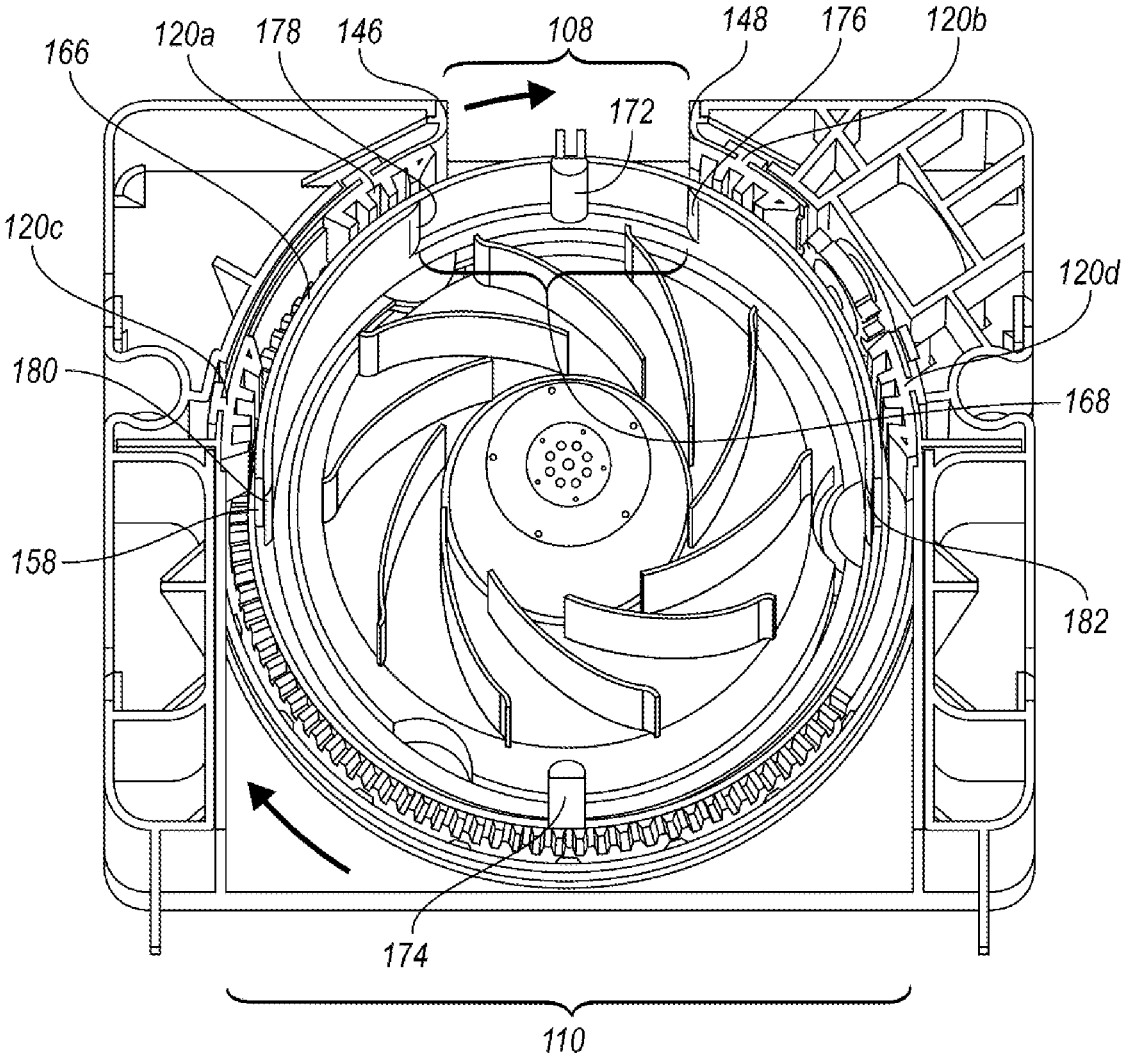
FIG. 3 illustrates a top-perspective view of the exemplary fan assembly including the damper disposed in a second position.

FIG. 3 illustrates a top view of the fan assembly 102 with the damper 114 disposed in a second position that partially blocks the first outlet 108 and the second outlet 110. A number of deflection posts such as a first deflection post 172 and a second deflection post 174 may extend from the third sidewall 166 so that the posts 172, 174 are disposed substantially in the middle of the first and second outlets 108, 110, respectively. The deflection posts 172, 174 may have an arcuate shape configured to deflect air around the deflection posts 172, 174 to the first and second outlets 108, 110. As an example, rounded surfaces of the posts 172, 147 may face the fan 112 and planar portions may face the outlet.

The fan assembly 102 may include a number of wipers 120 including a first wiper 120*a*, second wiper 120*b*, third wiper 120*c*, and a fourth wiper 120*d*. To use clock position or clock bearing, from the perspective of a viewer of FIG. 3, first deflection post 172 may be disposed at 12 o'clock and the second deflection post 174 may be disposed at 6 o'clock. The first wiper 120*a* may be disposed at approximately 11 o'clock, the second wiper 120*b* may be disposed at 1 o'clock, the third wiper 120*c* may be disposed at 9 o'clock and the fourth wiper 120*d* may be disposed at 3 o'clock. When the damper 114 is in the second position, end portions of the second sidewall 158 may be aligned with the first and second deflection posts 172, 174. In the second position, the second sidewall 158 may be disposed between the first and third wipers 120*a*, 120*c* and the third sidewall 166. As another example, when the damper 114 is in the second position, the second sidewall 158 may be disposed between the second and fourth wipers 120*b*, 120*d* and the third sidewall 166.

The third sidewall 166 may include a pair of edge portions 176, 178 and a pair of end portions 180, 182. The pair of edge portions 176, 178 may form the notch 168 of the third sidewall 166 and the pair of end portions 180, 182 may form distal ends of the third sidewall 166 that extend towards the second outlet 110. In one or more embodiments, the pair of edge portions 176, 178 and the pair of end portions 180, 182 may include a chamfer configured to direct air towards the first and second outlets 108, 110. When the damper 114 is in the first position (FIG. 2) portions of the second sidewall 158 may overlap or cover, in the radial direction, the end portions 180, 182.

In one or more embodiments, portions of the first outlet 108, the wiper, and the third sidewall 166 may be aligned substantially with one another. As an example, the second end 148 of the first sidewall 106 may be aligned with an end of the second wiper 120*b* and the edge portion 176. On the other hand, the first end 146 of the first sidewall 106 may be circumferentially offset from an end of the first wiper 120*a* and the second edge portion 178 may be circumferentially offset from the end of the first wiper 120*a*. In other words, the first end 146 may be positioned closest to the 12 o'clock position and the end of the first wiper 120*a*, and the second edge portion 178, respectively may be spaced further away from the 12 o'clock position. This arrangement may create an angled wall configured to route air (if the fan 112 rotates in the clockwise direction) towards the first outlet 108.

Figure 4:
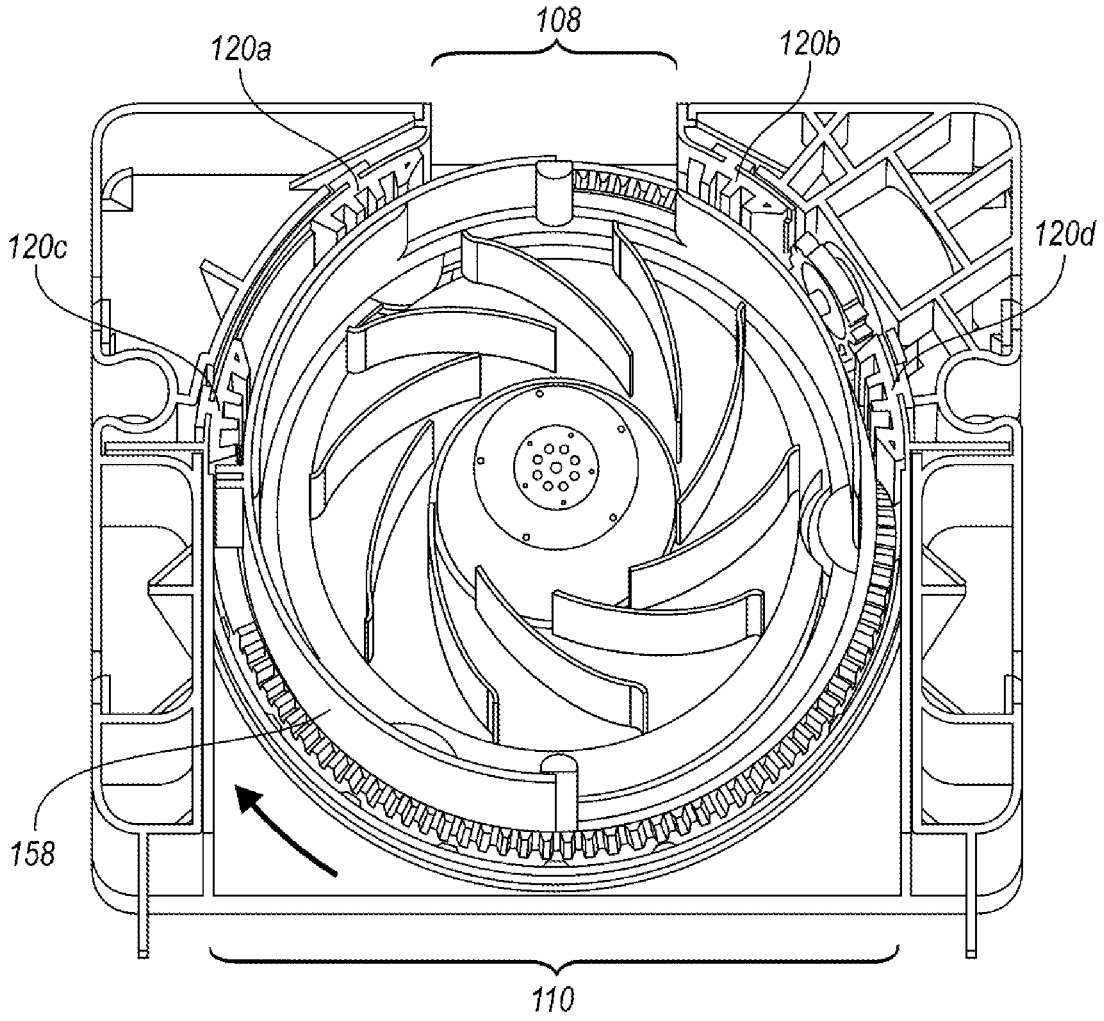
FIG. 4 illustrates a top-perspective view of the exemplary fan assembly including the damper disposed in a third position.

FIG. 4 illustrates a top view of the fan assembly 102 with the damper 114 positioned in a third position so that the first outlet 108 is completely closed and the second outlet is completely open. Distal end portions of the second sidewall 158 may overlap the third sidewall 166 in the radial direction. When the damper 114 is in the third position, the second sidewall 158 may be disposed between each of the wipers 120*a*-120*d* and the third sidewall 166. As the fan 112 rotates air is routed from away from the first sidewall 106 towards the second outlet 110. Should some portion of the air move towards the first outlet 108, between the first and third sidewalls 106, 166, the wipers 120*a*-120*d* and the second sidewall 158 are arranged to block the air from moving towards the first outlet 108.

Figure 5:
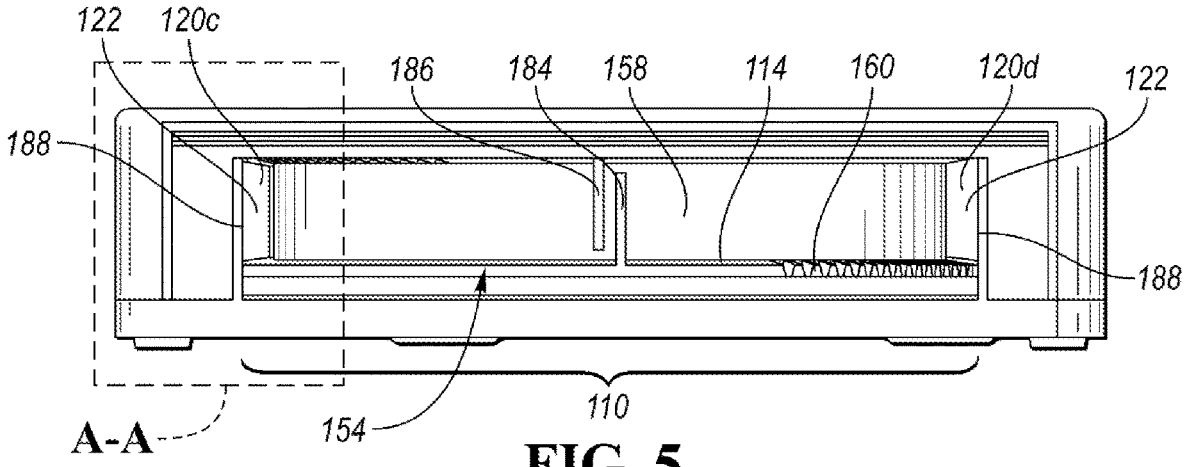
FIG. 5 illustrates a plan view of the exemplary fan assembly according to one or more embodiments.

FIG. 5 illustrates a plan view of the fan assembly 102. In this view the fan assembly is shown from the perspective of one looking at the second outlet 110. The damper 114 may be disposed on a base portion of the fan assembly 102. The annular rim 156 and gear teeth 160 may be disposed between the base portion and the second sidewall 158. A number of protrusions 184, 186 may extend in a radial direction from the second sidewall 158. The protrusions 184, 186 may be positioned so that when the damper is in the second position, one or more of the protrusions 184, 186 may be positioned adjacent to or contact one or more portions of one of the wipers 120*a*-120*d* to further minimize air traveling circumferentially between the wipers 120*a*-120*d* and the second sidewall 158. The third and fourth wipers 120*c*, 120*d* include the main body 122 and portions of the main body may extend circumferentially along an inner surface 188 of the first sidewall 106.

Figure 5A:
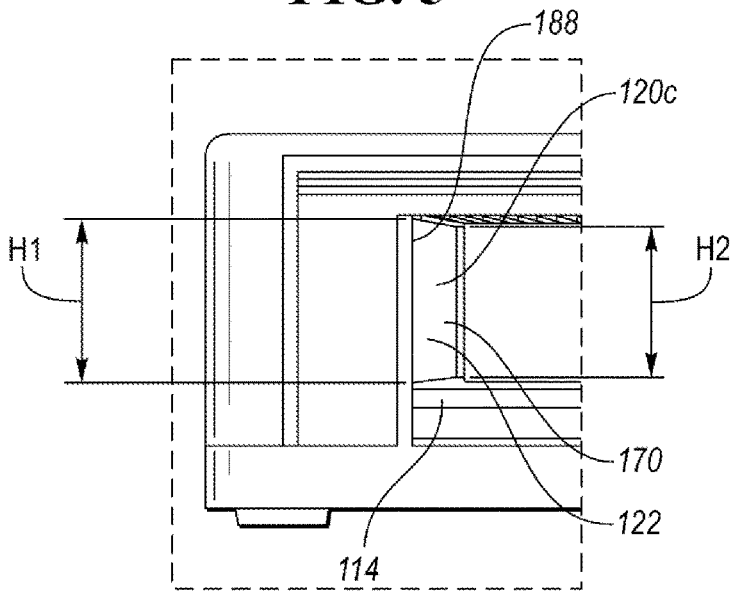
FIG. 5A illustrates a detailed-plan view of the exemplary fan assembly taken along the lines A-A in FIG. 5.

FIG. 5A illustrates a detailed-plan view taken along the lines A-A in FIG. 5. In one or more embodiments, the main body 122 of one or more of the wipers 120*a*-120*d* including the third wiper 120*c* may be tapered in the radial direction. As an example, the main body 122 may have a first height H1 and a distal end of a portion the wiper such as one or more of the fingers 170 may have a second height H2 that may be less than the first height H1. As mentioned above, the wipers 120*a*-120*d* may be disposed above portions of the annular rim 116 in the axial direction.

Figure 6:
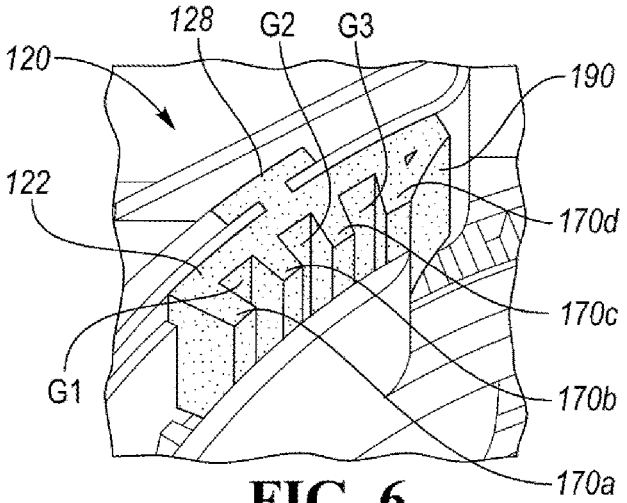
FIG. 6 illustrate a perspective view of an exemplary wiper disposed in the fan assembly.

FIG. 6 is a perspective view of the wiper 120. The wiper 120 includes a main body 122 and a number of fingers 170*a*-170*d* that may extend from the main body 122. The fingers may be spaced apart from one another to form a number of pockets G1-G3. The pockets G1-G3 may be configured to trap leaked air traveling circumferentially around the first wall 106. In one or more embodiments, an end portion of the wiper 120 may include a finger 170*d* that includes an angled surface 190 that is angled with respect to the other fingers 170*a*-170*c*. The angled finger surface 190 may be configured to route the air towards the first or second outlets 108, 110.

The words used in the specification are words of description rather than limitation, and it is understood that various changes may be made without departing from the spirit and scope of the disclosure. As previously described, the features of various embodiments may be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. As such, embodiments described as less desirable than other embodiments or prior art implementations with respect to one or more characteristics are not outside the scope of the disclosure and may be desirable for particular applications.

What is claimed is:

1. A fan assembly for use in an appliance, the fan assembly comprising:

a housing including a first sidewall forming a first outlet and a second outlet;

a fan disposed in the housing and configured to expel cooled air through the first outlet and the second outlet to a number of compartments of the appliance;

a damper including an annular rim and a second sidewall extending from at least a portion of the annular rim, the damper configured to rotate to completely or partially cover the first outlet, the second outlet, or the first outlet and the second outlet; and a wiper including a main body disposed between the first sidewall and the second sidewall and configured to block the cooled air from traveling between the first sidewall and the second sidewall, the wiper including an attachment portion extending from the main body into an aperture defined by the first sidewall to maintain the wiper between the first sidewall and the second sidewall.

2. The fan assembly of claim 1, wherein the main body extends circumferentially along at least a portion of the first sidewall.

3. The fan assembly of claim 1, wherein the aperture is a slot and the attachment portion engages an inner periphery of the slot to form a force-fit condition.

4. The fan assembly of claim 1, wherein the attachment portion includes a retention flange extending along a portion of an outer peripheral surface of the first sidewall.

5. The fan assembly of claim 1, wherein the wiper includes a number of fingers extending substantially radially from the main body towards the second sidewall.

6. The fan assembly of claim 5, further comprising a third sidewall arranged coaxially with respect to the first sidewall and the second sidewall and radially spaced apart from the number of fingers to form a gap, and the second sidewall is configured to move within the gap as the damper rotates.

7. The fan assembly of claim 5, wherein a first finger of the number of fingers extends substantially orthogonal to the main body and a second finger of the number of fingers is oblique to the main body.

8. A fan assembly for use in an appliance, the fan assembly comprising:

a housing including a first sidewall forming a first outlet and a second outlet;

a fan disposed in the housing and configured to expel cooled air through the first outlet and the second outlet to a number of compartments of the appliance;

a damper including an annular rim and a second sidewall extending from at least a portion of the annular rim, the damper configured to rotate to completely or partially cover the first outlet, the second outlet, or the first outlet and the second outlet;

a wiper including a main body disposed between the first sidewall and the second sidewall and configured to block the cooled air from traveling between the first sidewall and the second sidewall, wherein the wiper includes a number of fingers extending substantially radially from the main body towards the second sidewall; and a third sidewall arranged coaxially with respect to the first sidewall and the second sidewall and radially spaced apart from the number of fingers to form a gap, and the second sidewall is configured to move within the gap as the damper rotates.

9. The fan assembly of claim 8, wherein a first finger of the number of fingers extends substantially orthogonal to the main body and a second finger of the number of fingers is oblique to the main body.

10. The fan assembly of claim 8, wherein the wiper includes an attachment portion extending from the main body and fixed to the first sidewall.

11. The fan assembly of claim 10, wherein the attachment portion includes an arm radially extending from the main body and the arm is disposed in an aperture formed by the first sidewall.

12. The fan assembly of claim 11, wherein the aperture is a slot and the arm engages an inner periphery of the slot to form a force-fit condition.

13. The fan assembly of claim 10, wherein the attachment portion includes a retention flange extending along a portion of an outer peripheral surface of the first sidewall.

14. A fan assembly for use in an appliance, the fan assembly comprising:

a housing including a first sidewall forming a first outlet and a second outlet;

a fan disposed in the housing and configured to expel cooled air through the first outlet and the second outlet to a number of compartments of the appliance;

a damper including an annular rim and a second sidewall extending from at least a portion of the annular rim, the damper configured to rotate to completely or partially cover the first outlet, the second outlet, or the first outlet and the second outlet; and a wiper including a main body disposed between the first sidewall and the second sidewall and configured to block the cooled air from traveling between the first sidewall and the second sidewall, wherein the wiper includes a number of fingers extending substantially radially from the main body towards the second sidewall, wherein one of the number of fingers extends substantially orthogonal to the main body and another of the number of fingers is oblique to the main body.

15. The fan assembly of claim 14, wherein the wiper includes an attachment portion extending from the main body and fixed to the first sidewall.

16. The fan assembly of claim 15, wherein the attachment portion includes an arm radially extending from the main body and the arm is disposed in an aperture formed by the first sidewall.

17. The fan assembly of claim 16, wherein the aperture is a slot and the arm engages an inner periphery of the slot to form a force-fit condition.

* * * * *